United States Patent [19]

Brazelton

[11] Patent Number: 4,778,280

[45] Date of Patent: Oct. 18, 1988

[54] MIXING APPARATUS

[75] Inventor: Carl L. Brazelton, Bourbonnais, Ill.

[73] Assignee: Stranco, Inc., Bradley, Ill.

[21] Appl. No.: 905,674

[22] Filed: Sep. 9, 1986

Related U.S. Application Data

[63] Continuation-in-part of Ser. No. 878,114, Jun. 25, 1986, abandoned.

[51] Int. Cl.[4] ..... B01F 3/12; B04B 11/10

[52] U.S. Cl. ..... 366/136; 366/150; 366/165; 366/177; 366/181; 366/182; 366/190; 366/263

[58] Field of Search ..... 366/150, 165, 181, 263, 366/341, 347, 601, 136, 137, 138, 190, 348, 132, 182, 152, 177

[56] References Cited

U.S. PATENT DOCUMENTS

| | | | |
|---|---|---|---|
| 1,445,112 | 2/1923 | Titus et al. | 366/182 |
| 2,272,573 | 2/1942 | Messmore | 366/263 |
| 2,973,187 | 2/1961 | Wehmer | 366/139 |
| 3,104,424 | 9/1963 | Immel | 366/182 |
| 3,147,955 | 9/1964 | Harvey et al. | 366/150 |
| 3,941,517 | 3/1976 | Miyahara | 366/263 |
| 4,125,331 | 11/1978 | Chisholm | 366/136 |
| 4,233,265 | 11/1980 | Gasper | 366/341 |
| 4,340,308 | 7/1982 | Thorp | 366/137 |
| 4,345,841 | 8/1982 | Day | 366/165 |
| 4,518,261 | 5/1985 | Sekimoto et al. | 366/150 |
| 4,571,092 | 2/1986 | Switall | 366/153 |
| 4,664,528 | 5/1987 | Rodgers et al. | 366/137 |
| 4,688,945 | 8/1987 | Brazelton et al. | 366/163 |

FOREIGN PATENT DOCUMENTS

| | | | |
|---|---|---|---|
| 0154978 | 9/1985 | European Pat. Off. | 366/150 |

*Primary Examiner*—Harvey C. Hornsby
*Assistant Examiner*—Joseph S. Machuga
*Attorney, Agent, or Firm*—Emrich & Dithmar

[57] ABSTRACT

The mixing apparatus includes a centrifugal pump having a casing and an impeller located therein. The casing has a axially extending tubular inlet located centrally on its end wall, the discharge being a tubular projection on the side wall's casing. A second casing substantially identical to the casing of the pump, has a tubular projection on one of its end walls coupled to the inlet of the first mentioned casing. Water is delivered to a tubular projection on the side wall of the second casing. Particulate polymer is delivered to the other end wall of the second casing. The swirling water in the second casing creates a lower pressure at its discharge to draw the polymer downwardly and into the first casing where it is vigorously mixed with the water.

24 Claims, 2 Drawing Sheets

MIXING APPARATUS

CROSS-REFERENCE TO RELATED APPLICATION

This is a continuation-in-part of U.S. application Ser. No. 878,114, filed June 25, 1986, and entitled "Mixing Apparatus".

BACKGROUND OF THE INVENTION

The present invention relates to an apparatus for mixing a substance and a liquid diluent. The invention has particular application in the preparation of mixtures of a dry or liquid polyelectrolyte and water.

Polymers (used herein interchangeably with the term "polyelectrolyte") are commonly used in water treatment equipment in order to remove solids suspended in the water. Polymers carry an electrostatic charge which attracts particles suspended in water. Since virtually all solids carry a negative or positive charge, they are attracted to these polymers. Polymers have extremely large molecules with millions of charge sites that attract suspended particles. Synthetic polymers are available in dry and liquid form. Dry polymer is desirable for many applications because it has low weight, which saves on shipping expenses; can be easily stored and shipped in plastic lined sacks, which are relatively inexpensive as compared with disposable metal drums which must be used for liquid polymer, and has indefinite shelf life, whereas with liquid polymers the more dilute the mixture the shorter the shelf life. Furthermore, dry polymers have been approved as safe and effective in certain food grade and potable applications, whereas many liquid products have not received such approval. However, dry polymer must be mixed with water before it can be used. The dry polymer is hygroscopic and its suspension in water are thixotropic. In other words, the dry polymers do not readily mix with water. Many existing mixing systems are subject to agglomeration of dry polymer particles during the wetting/dispersing step.

In certain instances, a liquid polymer is the choice. Liquid polymers may be either of the solution type or the emulsion type. It would be desirable to provide a mixing apparatus which can be readily converted to process liquid polymer.

SUMMARY OF THE INVENTION

It is a general object of the present invention to provide a mixing system for mixing dry particulate material and a liquid diluent, which avoids the disadvantages of prior mixing systems while affording additional structural and operating advantages.

Another important object of the invention is the provision of a mixing apparatus of the type set forth, which is of relatively simple and economical construction.

Yet another object of the invention is the provision of a mixing apparatus of the type set forth, which effectively prevents agglomeration of dry particulate material.

It is another object of the present invention to provide a mixing apparatus which can readily be modified to accommodate liquid polymer instead of dry polymer, and to switch between the two in an on-line configuration.

In summary, there is provided an apparatus for mixing a substance and a liquid diluent, the apparatus comprising: a centrifugal pump including a motor and a generally annular first casing and an impeller in the first casing rotated by the motor, the first casing having a discharge at the periphery thereof and an inlet generally centrally thereof, and a generally annular second casing having a substance inlet and a diluent inlet and a discharge, the diluent inlet being generally tangent to the casing, the discharge of the second casing being located generally centrally thereon, the substance inlet being adapted to be coupled to a source of the substance, the diluent inlet being adapted to be coupled to a source of diluent, the discharge of the second casing being coupled to the inlet of the first casing.

In connection with the foregoing objects, it is another object of the invention to provide a mixing apparatus of the type set forth, which introduces all of the liquid diluent in an initial wetting stage.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENT

Figure 1:
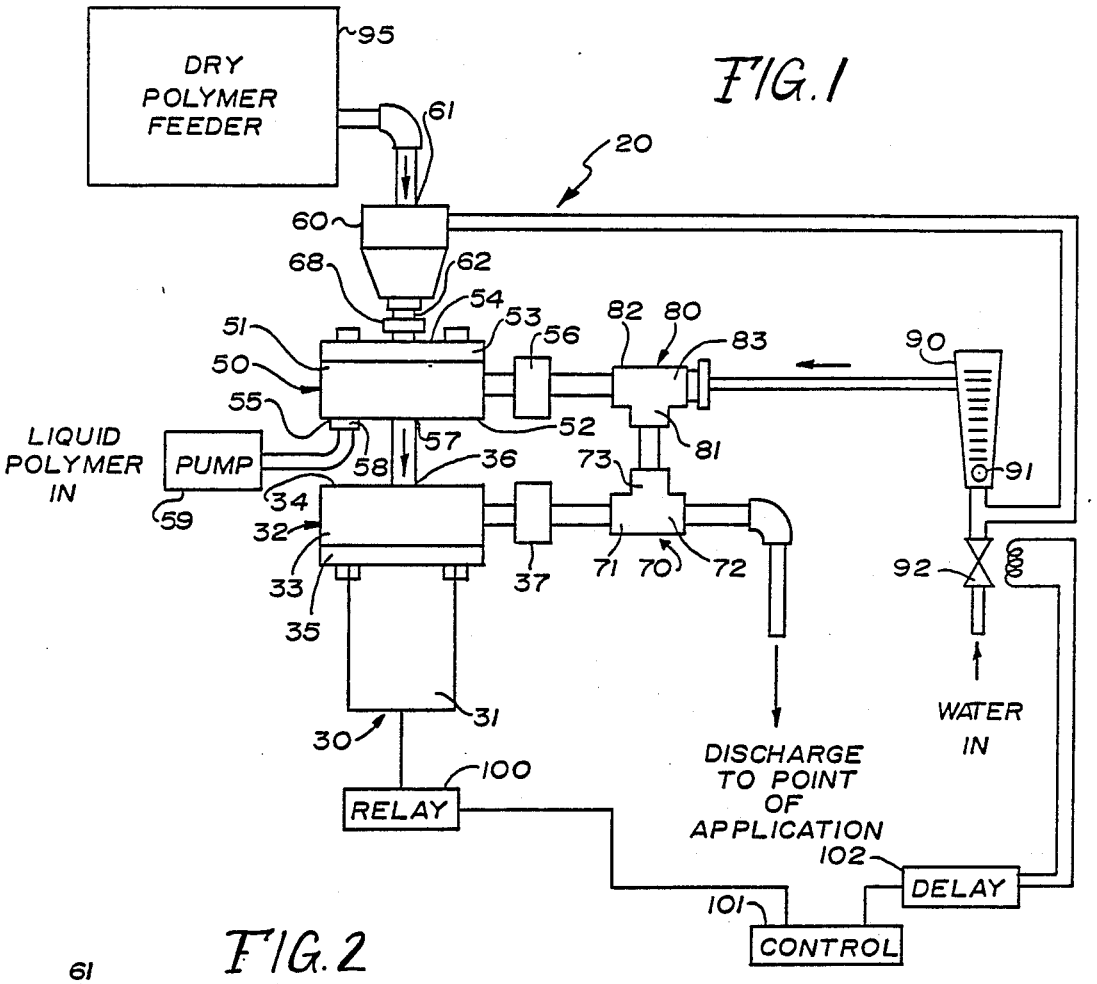
FIG. 1 is a schematic view of a mixing apparatus incorporating the features of the present invention.
Figure 7:
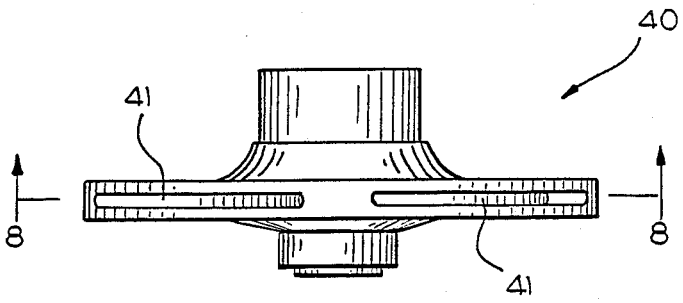
FIG. 7 is an elevational view of the impeller.
Figure 8:
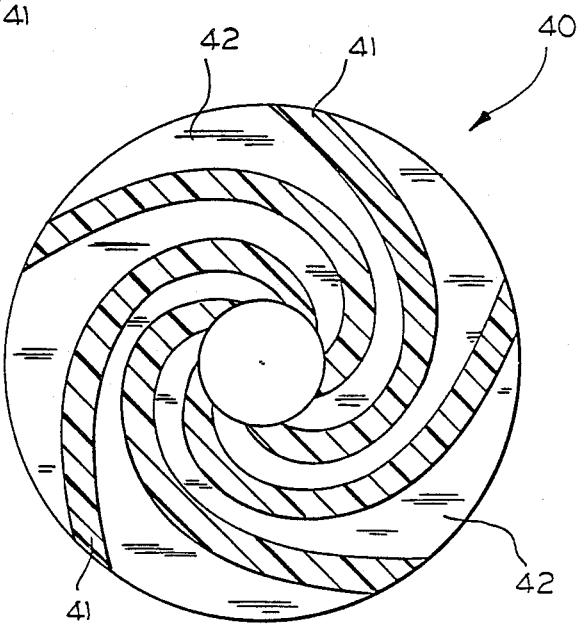
FIG. 8 is a view in section taken along the line 8—8 of FIG. 7.

Turning now to the drawings and more particularly to FIG. 1 thereof, there is depicted a mixing apparatus 20 incorporating the features of the present invention. The mixing apparatus 20 includes a centrifugal pump 30 having a motor 31 and a casing 32 which contains an impeller 40 (FIGS. 7 and 8). The pump 30 has an inlet 36 and a discharge 37. In a particular embodiment, the pump 30 was made by Sta-Rite, produced 0.75 horse power and the impeller rotated at 3,450 RPM.

The apparatus 20 further comprises a second casing 50 which has construction very similar to the casing 32 but the casing 50 contains no impeller. The casing 50 includes a dry polymer inlet 54, a liquid polymer inlet 55, a water inlet 56, and a discharge 57. Preferably a check valve 58 is coupled to the liquid polymer inlet 55.

A funnel 60 is mounted to the casing 50. It includes a polymer inlet 61 and a discharge 62 coupled to the dry polymer inlet 54 of the casing 50 by means of a valve 68. The valve 68 can be replaced by a conduit if the pump 59 is not employed or a plug 96 (FIG. 9) is employed.

The mixing apparatus 20 also comprises a T-fitting 70 having one leg 71 connected to the discharge 37, a second leg 72 constituting the main discharge of the mixing apparatus 20, and a third leg 73. A second T-fitting 80 has a first leg 81 connected to the leg 73, a second leg 82 connected to the water inlet 56 and a third leg 83. The leg 83 is coupled to a flowmeter 90. A constant flow valve may be employed in place of the flowmeter 90. A source of water is coupled to a solenoid valve 92 the outlet of which is connected to the flowmeter 90. In the absence of electrical power, the valve 92 is automatically closed. The flowmeter 90 has a control knob 91 to enable selection of the rate of water flow.

In operation, dry particulate polymer is delivered to a feeder 95 which transports the polymer to a point where it drops into the funnel 60 which guides the polymer into the casing 50. Water is delivered to the casing 50 tangentially so it swirls therein creating a region of lower pressure adjacent to the discharge 57 drawing the polymer and water downwardly and into the casing 32 wherein the impeller 40 vigorously mixes the two. The polymer at the discharge 37 is a thoroughly wetted and homogenous slurry. The liquid polymer is extended to the leg 72 from which it is taken for use in treating water or the like. Because of the dynamics of the apparatus 20, the polymer does not pass through the recirculation path defined by the leg 73 of the T-fitting 70 and the leg 81 of the T-fitting 80.

Liquid polymer is pumped into the casing 50 by means of a pulsating-pump 59, such as one made by Liquid Metronics, Incorporated of Acton, Mass. When the apparatus is used to deliver dry polymer, the pump 59 is de-energized. When the apparatus 20 is used to dilute liquid polymer, the valve 68 is closed and the pump 59 is enabled. The check valve 58 prevents the contents of the casing 50 from exiting at the inlet 55. The polymer mixes with the water by the action of the impeller 40, in much the same manner as the dry polymer. However, because the system is basically closed, a portion of the diluted polymer at the discharge 37 will be recirculated by passing through the legs 73 and 81 back to the water inlet 56. This recirculated portion will be further diluted and mixed along with fresh polymer and water. When the water is turned off, the liquid continues to recirculate. Thus, residence time is controlled by the water flow rate. The apparatus 20 can be quickly modified to process dry or liquid polymer as required. The apparatus can be readily switched back and forth, on line.

Figure 5:
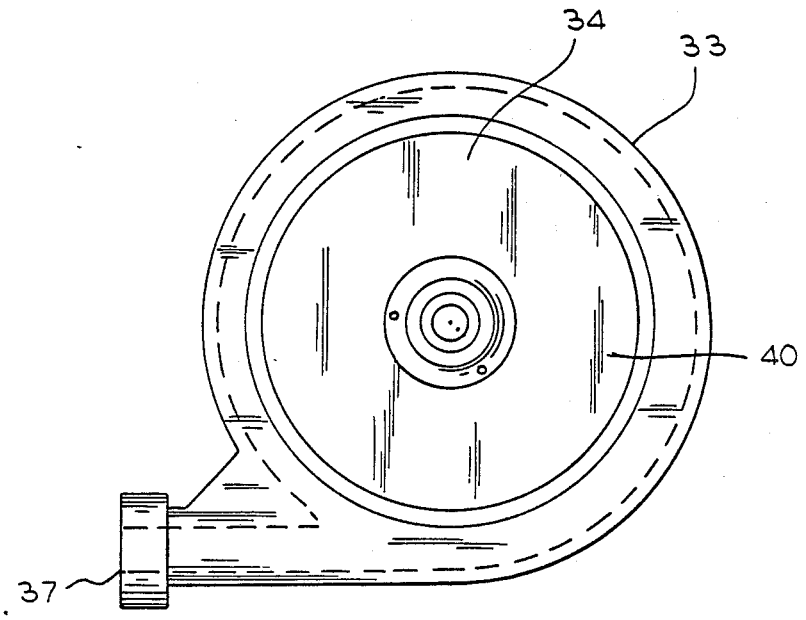
FIG. 5 is a top plan view of the pump impeller casing of the mixing apparatus.
Figure 6:
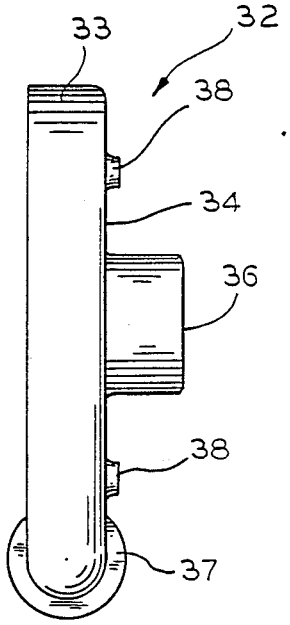
FIG. 6 is an elevational view of the casing.

Referring to FIGS. 5 and 6, the casing 32 is defined by a generally annular side wall 33, end walls 34 and a flange 35 (FIG. 1) which is attached to the housing of the motor 31. The inlet 36 is an axially extending, tubular projection on the end wall 34 located generaly centrally thereon. The discharge 37 is a tubular projection on the side wall 33 and disposed generally tangent thereto. The casing 32 has three ports 38 (two are shown) any one or more of which may be closed. The others can be used to be coupled to receive liquids.

As can be seen in FIGS. 7 and 8, the impeller 40 has spiral vanes 41 separated by spiral spaces 42. The impeller 40 is threaded to the motor shaft (not shown).

The polymer and water passing into the casing 32 at the center thereof are vigorously mixed as they pass through the rotating impeller and enter the turbulent zone at the inside surface of the side wall 33 and exit tangentially through the discharge 37.

Referring back to FIG. 1, the casing 50 is identical to the casing 32, but is inverted in orientation. The casing 50 has a generally annular side wall 51 and an end wall 52 integral therewith. The end wall 52 carries centrally thereon an axially extending, tubular projection defining the discharge 57. The inlet 55 is preferably located in the end wall 52 near the periphery thereof. Preferably the cover 53 is transparent so that one can see the interior of the casing 53 and what is transpiring therein. A tubular projection extends from the side wall 50 generally tangent thereto and defines the inlet 56 of the casing 50. A nipple is threaded into the projections on the two casing to interconnect the discharge 57 and the inlet 36. The check valve 58 is coupled to one of the ports in the wall 52 (like the ports 38). Other liquids, such as surfactants, may be applied to the other ports to enable several liquids to be simultaneously applied.

Water is introduced into the interior of the casing 50 through the inlet 56 and because it is introduced tangentially, the water swirls around and creates a zone of lower pressure adjacent to the discharge 57, tending to draw down downwardly the particulate polymer introduced to the inlet 54. This actions helps to cause more thorough mixing action and a more homogeneous product.

Figure 2:
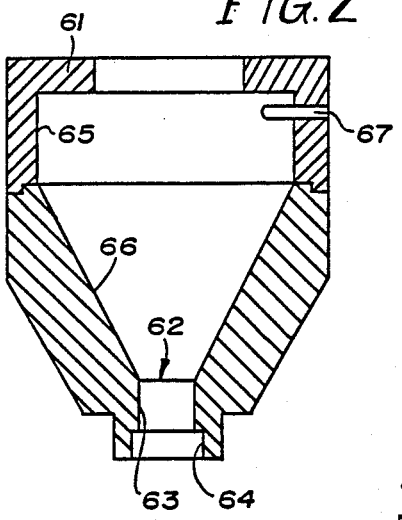
FIG. 2 is an enlarged view in vertical section of the funnel in the mixing apparatus.
Figure 3:
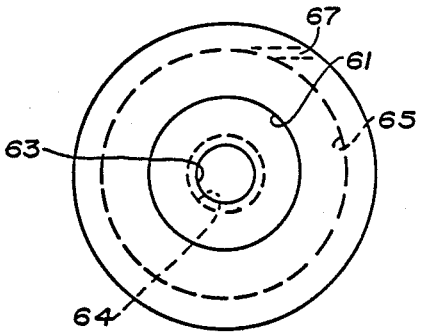
FIG. 3 is a top plan view of the funnel.

Referring to FIGS. 2 and 3, the funnel 60 has a polymer inlet 61 and a discharge 62, the latter being defined by a smaller diameter throat 63 and a larger mouth 64. The interior of the funnel 60 in the region of the polymer inlet 61 has a cylindrical surface 65. A conical surface 66 extends from the surface 65 to the discharge 62. A water inlet 67 in the surface 65 is generally tangential thereto, so that water introduced into such inlet will swirl about the surface 65 and then downwardly along the surface 66, tending to wash such surfaces and maintain them free of the particulate polymer which is introduced through the inlet 61. This operation tends to prevent the polymer from agglomerating in the funnel 60 and prewets the polymer to facilitate further wetting in subsequent stages. In an operative form of the invention, the inlet 61 was round having a two-inch diameter and the mouth 63 was round having a 0.75-inch diameter. This structure tends to minimize so-called "back wicking", that is the tendency to wet the dry polymer upstream and cause it to clump of agglomerate.

Figure 4:
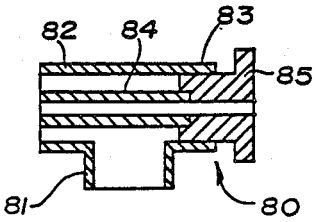
FIG. 4 is a view in vertical section of the T-fitting of the mixing apparatus which receivs the recirculated polymer and the water.

Referring to FIG. 4, the T-fitting 80 has an inner conduit 84 coaxial with the legs 82 and 83. A bushing 85 blocks the space between the leg 83 and the conduit 84. Water is introduced through the bore in the bushing 85 through the conduit 84 and into the water inlet 56. When the funnel 60 is replaced by the plug 96 in order to feed liquid polymer, a portion of the polymer from the discharge 37 passes through the leg 81 and into the leg 82. The recirculating polymer and the water are simultaneously introduced into the casing 50 where they together swirl downwardly toward the discharge 56. The conduit 84 decreases the pressure difference between the water and the recirculating polymer so that the water pressure is not directly "fighting" the pressure of the recirculating polymer in part created by the centrifugal pump 30.

AC power for the pump motor 31 is supplied via a relay 100, the winding of which is coupled to one output of a control circuit 101. When it is desired to energize the motor 31, the control circuit 101 is caused to produce a signal which energizes the winding of the relay 100 causing its contacts to close. A second output of the control circuit 101 is coupled by way of a delay circuit 102 to the winding of the solenoid valve 92. The control circuit generates an output that energizes such winding to cause the valve to opens and therefore permit water to be introduced.

When the apparatus 20 is idle, the casing 50 is flooded. It has been determined that when the pump motor 31 and the solenoid valve 92 are simultaneously energized, the water delivered to the casing 50 is caused to splash into the funnel 60 and out the inlet 61. But, if the pump motor 31 is energized just prior to the introduction of water, such splashing does not occur. In experimentation, it has been found that the pump motor 31 should be energized about one second prior to delivering water to the casing 50. Thus, the delay circuit 102 provides a delay of about one second. On the other hand, the delay cannot be too long because water in the casings 32 and 50 would be evacuated completely. When it is desired to turn on the mixing apparatus 20, the control circuit 101 provides electrical signals on its outputs one of which substantially immediately energizes the relay 100 to cause the pump motor 31 to immediately become energized and the other of which causes energization of the solenoid valve 92 about one second later by virtue of the delay circuit 102.

The same kind of phenomonon tends to occur when the apparatus 20 is turned off. In other words, if both the pump motor 31 and water are turned off at the same time, the splashing tends to occur. A reverse delay is incorporated for this purpose. The relay 100 incorporates a so-called "off" delay (not shown) and the delay circuit 102 is basically bypassed. Thus, when it is desired to turn off the apparatus 20, the electrical signals developed by the control circuit 101 are terminated. The valve 92 is immediately closed and water to the funnel 60 immediately interrupted. After the delay period has passed, the relay 100 opens and the pump motor 31 is deenergized. The preferred "off" delay is also on the order of about one second.

It should be quite clear that there are many ways to accomplish the operation just described. The relay 100 does not include any "on" delay, but does include one second of "off" delay. A separate delay circuit could be used instead. By the same token, the "on" delay furnished by the delay circuit 102 could be provided directly in the solenoid valve 92. Or, both delays could be incorporated directly into the control circuit 101. Depending upon the overall system in which the apparatus 20 is used, the control circuit 101 could simply be a switch mechanism of some kind.

Figure 9:
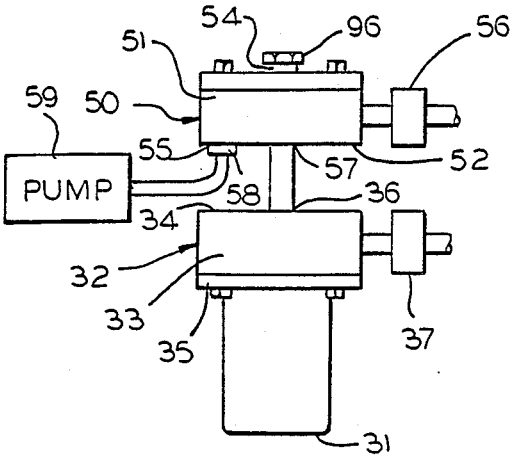
FIG. 9 depicts a modification of the mixing system designed to process liquid polymer.

An alternative embodiment is depicted in FIG. 9. Instead of using a valve 68, the tunnel 60 can be removed and replaced with a plug 96, when liquid polymer is to be processed.

What has been described therefore is an improved mixing apparatus designed to create a liquid polymer from a dry particulate polymer, the liquid polymer effluent being thoroughly wetting and highly homogeneous. The mixing apparatus also has means to accept a liquid polymer instead of dry polymer, which liquid polymer is diluted with water.

I claim:

1. Apparatus for mixing a dry particulate polymer or a liquid polymer and a liquid diluent, said apparatus comprising: a centrifugal mixing pump including a motor and a generally annular first casing and an impeller housed within said first casing and rotated by said motor, said first casing having a discharge at the periphery thereof and an inlet generally centrally thereof, a second casing having a generally annular side wall and first and second end walls respectively at the ends of said side wall, said second casing having a particulate inlet and a diluent inlet and a discharge, said diluent inlet being generally tangent to said side wall, said particulate inlet being in said first end wall generally centrally thereon, means for closing said particulate inlet, the discharge of said second casing being in said second end wall generally centrally thereon, thereby to create a swirling flow of diluent in said second casing and a region of lower pressure in the region of the discharge thereof to draw the particulate polymer from said particulate inlet and liquid from said diluent inlet to the discharge of second casing, said particulate inlet being adapted to be coupled to a source of dry particulate material, said diluent inlet being adapted to be coupled to a source of diluent, the discharge of said second casing being coupled to the inlet of said first casing, said second casing having a liquid polymer inlet, a check valve coupled to said liquid polymer inlet and being adapted to be coupled to a source of liquid polymer, and feedback means coupling the discharge of said first casing to the diluent inlet of said second casing.

2. The mixing apparatus of claim 1, and further comprising a flowmeter coupled between the source of diluent and the diluent inlet.

3. The mixing apparatus of claim 1, and further comprising a funnel coupled to said particulate inlet for receiving the dry particulate material and directing it to said particulate inlet.

4. The mixing apparatus of claim 1, wherein said first end wall is transparent.

5. The mixing apparatus of claim 1, wherein said liquid polymer inlet is in said second end wall.

6. The mixing apparatus of claim 1, wherein said means for closing said particulate inlet includes valve means coupling the dry particulate polymer to the particulate inlet.

7. The mixing apparatus of claim 1, wherein said first casing has a generally annular side wall and a first end wall at the end thereof.

8. The mixing apparatus of claim 1, wherein the discharge of said first casing is a tubular projection thereon substantially tangent thereto, the inlet of said first casing being an axially extending tubular projection thereon.

9. The mixing apparatus of claim 1, wherein said diluent inlet of said second casing is a tubular extension on said side wall and tangent thereto, the discharge of said second casing being an axially extending tubular projection on said second end wall.

10. The mixing apparatus of claim 1, wherein said first end wall of said second casing is separate from and attached to said side wall thereof.

11. The mixing apparatus of claim 1, and further comprising means for preventing the liquid diluent from being coupled to said discharge of said first casing.

12. The mixing apparatus of claim 1, and further comprising outer conduit means coupled to said diluent inlet of said second casing, and an inner conduit in said outer conduit and coupled between a source of water and said diluent inlet, said feedback means including means coupling said discharge of said first casing to said outer conduit.

13. The mixing apparatus of claim 1, and further comprising a funnel having a discharge coupled to said particulate inlet, said funnel having a first inlet adapted to be coupled to a source of dry particulate polymer and a second inlet adapted to be coupled to a source of liquid diluent, whereby liquid diluent washes the interior of said funnel to prevent agglomeration of the dry particulate matter in said funnel.

14. The mixing apparatus of claim 13, wherein said first inlet of said funnel is circular and has a diameter on the order of about two inches and the discharge of such funnel is circular and has a diameter on the order of about 0.75 inch.

15. The mixing apparatus of claim 13, wherein said funnel has a cylindrical interior surface near said inlet and a frustoconical interior surface between said cylindrical surface and the discharge of said funnel.

16. The mixing apparatus of claim 15, wherein said second inlet is generally tangent to said cylindrical interior surface for establishing a swirling flow of diluent around said cylindrical surface and down said frustoconical interior surface.

17. Apparatus for mixing a dry particulate material and a liquid diluent, said apparatus comprising: a centrifugal pump including a motor and a generally annular first casing and an impeller housed within said first casing and rotated by said motor, said first casing having a discharge at the periphery thereof and an inlet generally centrally thereof, and a generally annular second casing having a material inlet and a diluent inlet and a discharge, said diluent inlet being generally tangent to said casing, the discharge of said second casing being located generally centrally thereon, said material inlet being adapted to be coupled to a source of the particulate material, electrically operated valve means coupled to said diluent inlet, said valve being adapted to be coupled to a source of diluent, the discharge of said second casing being coupled to the inlet of said first casing, electrically controlled switch means for coupling a source of power to said centrifugal pump, and control means for operating said switch means and said valve means for selective opening and closing thereof, the mechanism defined by said switch means and said valve means and said control means including delay means to cause said switch means to automatically close before said valve means opens by a predetermined amount of first delay.

18. The mixing apparatus of claim 17, wherein the predetermined amount of first delay is on the order of about one second.

19. The mixing apparatus of claim 17, wherein the mechanism defined by said switch means and said valve means and said control means includes delay means to cause said switch means to automatically open after said valve means is closed by a predetermined amount of second delay.

20. The mixing apparatus of claim 19, wherein the predetermined amount of second delay is on the order of about one second.

21. The mixing apparatus of claim 19, wherein said second delay means is incorporated into said switch means.

22. The mixing apparatus of claim 17, wherein said switch means is a relay.

23. The mixing apparatus of claim 17, wherein said valve means is a solenoid operated valve.

24. The mixing apparatus of claim 17, and further comprising additional delay means coupled between said control means and said switch means to cause said switch means to automatically open after said valve means is closed.

* * * * *